United States Patent [19]

Müller

[11] 4,147,128

[45] Apr. 3, 1979

[54] APPARATUS FOR CLEANING AND DEVELOPING DIELECTRIC RECEPTOR SHEETS

[75] Inventor: Jürgen Müller, Munich, Fed. Rep. of Germany

[73] Assignee: AGFA-Gevaert AG, Munich, Fed. Rep. of Germany

[21] Appl. No.: 863,868

[22] Filed: Dec. 23, 1977

[30] Foreign Application Priority Data

Dec. 30, 1976 [DE] Fed. Rep. of Germany ..... 2659584

[51] Int. Cl.[2] ..... G03G 13/10

[52] U.S. Cl. ..... 118/652; 118/662; 271/276; 355/3 DR

[58] Field of Search ..... 118/652, 653, 644, 659, 118/660, 661, 662, DIG. 23; 427/15, 17, 19, 22; 355/3 CH, 3 DR, 15; 271/276, 277

[56] References Cited

U.S. PATENT DOCUMENTS

| | | | |
|---|---|---|---|
| 3,536,528 | 10/1970 | De Geest | 355/15 |
| 3,642,364 | 2/1972 | Egnaczak | 118/652 X |
| 3,706,489 | 12/1972 | Moxness | 355/3 DR |
| 3,814,517 | 6/1974 | Brock | 118/DIG. 23 |
| 3,936,184 | 2/1976 | Tanaka et al. | 355/15 |
| 3,986,455 | 10/1976 | Jeschke et al. | 271/276 X |
| 4,026,242 | 5/1977 | Boschet | 118/657 |
| 4,029,537 | 6/1977 | Kish | 271/276 X |

*Primary Examiner*—Mervin Stein
*Attorney, Agent, or Firm*—Peter K. Kontler

[57] ABSTRACT

Apparatus for removing dust from dielectric receptor sheets which are about to be introduced into an ionography imaging chamber for exposure to object-modulated X-rays or for developing latent images on such sheets has a drum which rotates about a horizontal axis and has a first section of larger radius which is shorter than a sheet and a second section of smaller radius which is longer than a sheet. Both sections have suction ports and grooves which can attract sheets to their external surfaces. A sheet which adheres to the external surface of the second section bypasses the upper level of a supply of developing liquid in a tank which is located below the drum and is relieved of dust or other foreign matter by a corona discharge device which is operative when the second section carries a sheet. A sheet whose median portion is attracted to the external surface of the first section and whose leading and trailing portions extend inwardly to the level of the external surface of the second section is caused to move successive increments of its median portion into contact with the developing liquid when the drum is rotated. The thus developed image of the sheet on the first section is thereupon fixed by moving past a heating device.

10 Claims, 1 Drawing Figure

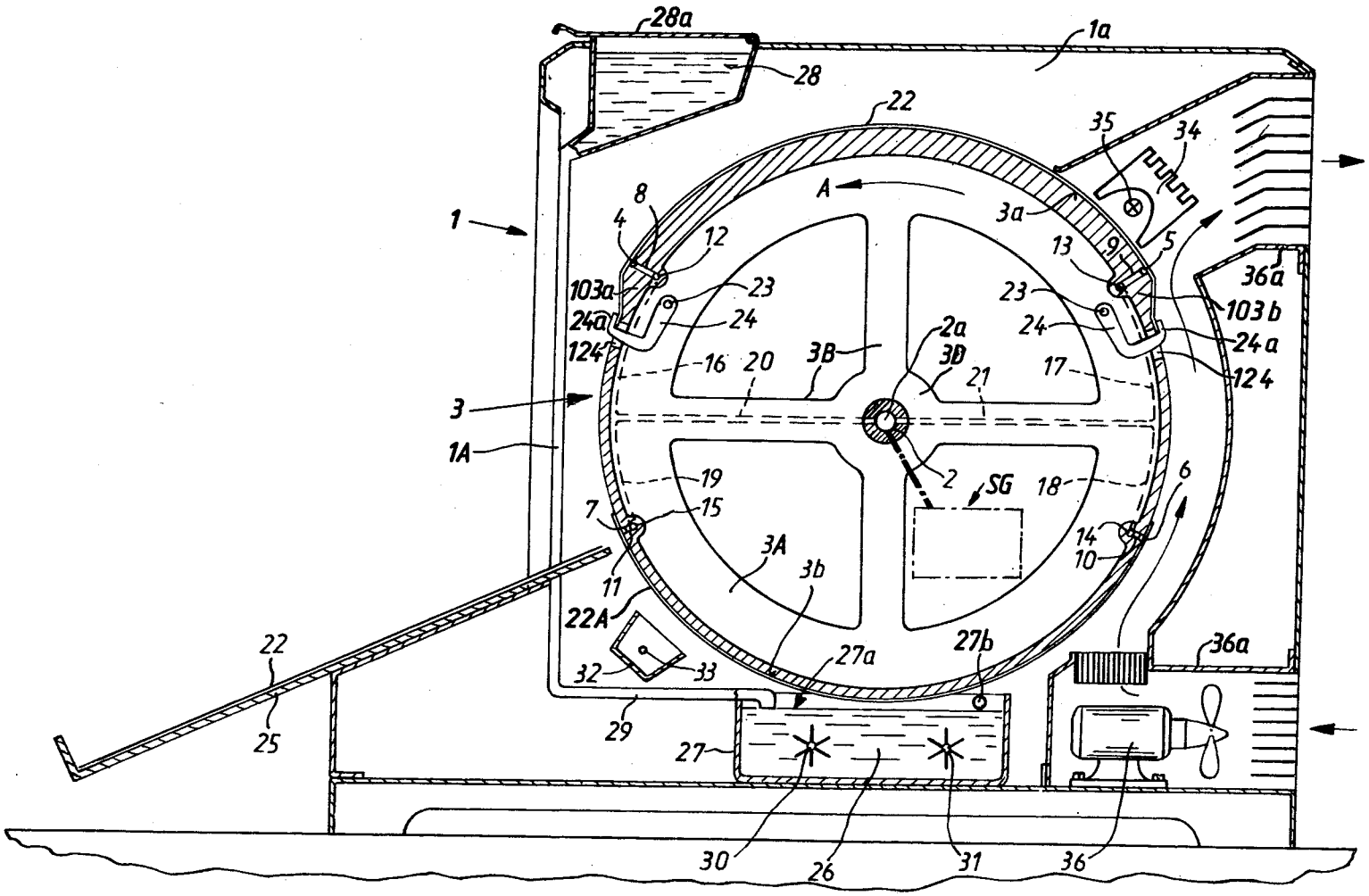
1a
28
28a
22
35
34
36a
103b
24a
124
5
9
13
23
24
3a
17
21
2a
3B
2
SG
18
6
14
10
36a
36
27b
31
26
30
27
29
33
32
22A
11
7
15
19
3A
3b
27a
3B
20
16
12
8
4
103a
24a
124
A
1
3
1A
22
25

APPARATUS FOR CLEANING AND DEVELOPING DIELECTRIC RECEPTOR SHEETS

BACKGROUND OF THE INVENTION

The present invention relates to improvements in apparatus for treating dielectric receptor sheets for latent images of objects, especially x-rayed objects, and more particularly to improvements in apparatus for developing dielectric receptor sheets to thereby convert latent images into visible images. Dielectric receptor sheets which can be treated in the apparatus of the present invention are used in ionography imaging chambers for exposure to object-modulated x-rays.

Commonly owned copending application Ser. No. 832,884 filed Sept. 13, 1977 by Manfred SCHMIDT et al. discloses an apparatus for making latent images of object-modulated X-rays. A dielectric receptor sheet is inserted into a drawer-like cassette prior to exposure to object-modulated X-rays. The exposure of dielectric sheet to X-rays is preceded by introduction of the cassette into a conditioning unit having means for destroying the charge on the dielectric receptor sheet. The cassette, with an image carrying sheet therein, is withdrawn from the X-ray machine and is introduced into a developing unit having means for converting latent images into visible images, preferably by resorting to toner particles.

The conditioning unit is actually a cleaning device which relieves the sheets of dust particles and/or other undesirable foreign matter prior to exposure of sheets to object-modulated X-rays.

OBJECTS AND SUMMARY OF THE INVENTION

An object of the invention is to provide a novel and improved apparatus which can be used for conditioning as well as for developing of latent images on dielectric receptor sheets.

Another object of the invention is to provide a relatively simple and compact apparatus which can perform the functions of presently known discrete dust removing and developing apparatus for dielectric receptor sheets and which can perform such functions upon dielectric receptor sheets which need not be confined in cassettes or analogous receptacles.

A further object of the invention is to provide the apparatus with novel and improved means for preventing contact between a developing medium and certain portions of dielectric receptor sheets.

An additional object of the invention is to provide the apparatus with novel and improved means for effecting separation of foreign matter from fresh dielectric receptor sheets, for developing the latent images of receptor sheets, and for further processing the developed images in a small area and by resorting to simple instrumentalities.

The invention is embodied in an apparatus for treatment of dielectric receptor sheets of predetermined length which are designed to receive latent images, especially latent images of X-rayed objects. The apparatus comprises a drum-shaped conveyor which is rotatable about a substantially horizontal axis and has a rim with first and second sections respectively having convex external surfaces of larger and smaller radii. The length of the first surface, as considered in the circumferential direction of the drum, is less than the length of a sheet and the length of the second surface at least equals but preferably exceeds the length of a sheet. The apparatus further comprises discrete first and second sheet attracting means which are respectively associated with the first and second sections of the rim and are operable to attract sheets to the respective surfaces whereby the leading and trailing portions of a sheet (which carries a latent image) whose median portion overlies the first external surface extend inwardly beyond the first section and preferably overlie the adjacent end portions of the second surface. The apparatus also comprises a liquid containing vessel which is disposed below the conveyor and means for maintaining the upper level of liquid (this liquid constitutes a developer of latent image on the median portion of a sheet which adheres to the first section) in the vessel in a plane which is located below the second surface but is sufficiently high to enable the liquid to contact the median portion of the sheet on the first section. The apparatus also comprises a corona discharge device or other suitable cleaning means which is adjacent to the conveyor and is operable to effect separation of dust or the like from a sheet which adheres to the second section.

A sheet which adheres to the first section and has been advanced beyond the vessel preferably travels past a heating device which fixes the developed image before the sheet is detached from the conveyor.

The means for attracting sheets to the first section of the conveyor preferably comprises mobile gripping members or analogous means which causes the leading and trailing portions of a sheet overlying the first surface to extend inwardly so that the leading and trailing portions of such sheet cannot come in contact with the liquid The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is a somewhat schematic fragmentary vertical sectional view of a combined sheet conditioning and developing apparatus which embodies the invention.

DESCRIPTION OF THE PREFERRED EMBODIMENTS

The drawing shows a combined sheet conditioning (cleaning) and developing apparatus which comprises a housing 1 whose side walls 1*a* (only one shown) support the bearings for the hollow horizontal shaft 2 of a rotary drum-shaped sheet transporting conveyor 3 consisting of metallic material. The conveyor 3 resembles a wheel having a cylindrical rim 3A, several radially extending spokes 3B and a hub 3D which is integral with or rigidly connected to the shaft 2. The rim 3A includes a first portion or section 3*a* having a convex external surface of larger radius and a second portion or section 3*b* having a convex external surface of smaller radius. A dielectric receptor sheet 22 which overlies and adheres to the external surface of the section 3*a* is properly mounted on the conveyor 3 for development of its latent image, and a sheet (22A) which overlies and adheres to the external surface of the section 3*b* is shown in a position of readiness to be relieved of dust and other foreign matter.

The means for attracting the median portion of a sheet 22 to the external surface of the section 3a is operated by suction. To this end, the external surface of the section 3a is formed with transversely (axially) and/or circumferentially extending grooves (two shown at 4 and 5) which communicate with radial bores or suction ports 8, 9 in the section 3a. The bores 8, 9 respectively communicate with axially extending channels 12, 13 and circumferentially extending channels 16, 17 which latter, in turn, communicate with channels 20, 21 machined into the spokes 3B. The discharge ends of the channels 20, 21 communicate with the axial bore 2a of the shaft 2, and the bore 2a is in communication (or can be connected, by means of a hose and a coupling, now shown) with the intake of a suction pump or another suitable suction generating device SG indicated by phantom lines.

A sheet 22A which overlies the external surface of the section 3b is attracted, in its entirety, to the section 3b by axially and/or circumferentially extending grooves 6, 7 in the external surface of the section 3b. The grooves 6, 7 respectively communicate with radially inwardly extending bores or suction ports 10, 11 of the hub 3A, and the ports 10, 11 respectively communicate with channels 14, 15 and 18, 19 which latter, in turn, communicate with the aforementioned channels 21, 20 in the spokes 3B. The length of the external surface of the section 3b, as considered in the circumferential direction of the conveyor 3, at least equals but preferably exceeds the length of a dielectric receptor sheet, and the length of the section 3a is somewhat less than the length of a sheet 22. The rim 3A has intermediate portions 103a, 103b which constitute a transition between the sections 3a and 3b and whose inwardly sloping external surfaces are respectively overlapped by the leading and trailing portions of a sheet 22 whose median portion overlies the external surface of the section 3a. Proper adherence of median portions of sheets 22 to the external surface of the section 3a is important because the liquid developing medium should not contact the inner sides of the sheets 22, i.e., those sides which abut against the section 3a. Liquid is most likely to penetrate between a sheet 22 and the external surface of the section 3a during immersion of the leading or trailing portion of the sheet into the developing bath 26. In order to prevent such penetration of liquid, the leading and trailing portions of the sheet 22 which is shown on the conveyor 3 overlie the intermediate portions 103a, 103b of the rim 3A so that their edges are located at the ends of or on the external surface of the section 3b. The radius of the external surface of the section 3b is selected in such a way that a sheet 22A thereon does not dip into the liquid bath 26 which is confined in an open-top vessel or tank 27 disposed in the housing 1 at a level below the conveyor 3. Therefore, the leading and trailing portions of a sheet 22A on the section 3b cannot descend to the upper level 27a of the liquid bath 26 in the vessel 27.

The means for urging the leading and trailing portions of a sheet 22 against the external surfaces of intermediate portions 103a, 103b comprises two gripping members or jaws 24 which are pivotally mounted in the rim 3A, as at 23, and whose sheet-engaging portions 24a extend outwardly through apertures 124 machined into the rim 3A adjacent to the intermediate portions 103a, 103b. The pivots 23 for the gripping members 24 are parallel to the axis of the shaft 2. Prior to introduction of a sheet 22 into the housing 1, the portions 24a of the gripping members 24 are located outwardly of and are thus spaced apart from the intermediate portions 103a, 103b. A magnetic or other suitable actuating mechanism (not specifically shown in the drawing) is provided, preferably at the exterior of the housing 1, to pivot the gripping members 24 to the operative positions which are shown in the drawing and in which the portions 24a maintain the leading and trailing portions of the sheet 22 flush against the external surfaces of the intermediate portions 103a, 103b. This insures that such leading and trailing portions cannot dip into the liquid bath 26 in the vessel 27.

Since the major (median) portion of a sheet 22 is attracted to the section 3a by suction, and since the leading and trailing portions of such sheet are held by the portions 24a of the respective gripping members 24, the developing liquid cannot penetrate between the sheet 22 and the section 3a when the conveyor 3 is rotated (in a counterclockwise direction, as indicated by arrow A) to move successive increments of the sheet 22 past the vessel 27.

An exposed dielectric receptor sheet 22 which is about to be treated by liquid in the vessel 27 is placed onto an upwardly sloping platform or tray 25 which extends to a sheet-admitting opening 1A of the housing 1. The conveyor 3 can be rotated by hand or by a suitable motor, not shown, and the sheet 22 or the uppermost sheet of a stack of sheets 22 on the platform 25 is pushed upwardly to abut against the portion 24a of the leading gripping member 24 (this gripping member is shown at the ten o'clock position of the conveyor (3) whereupon the gripping member 24 pivots to clamp the leading portion of the sheet 22 against the intermediate portion 103a of the rim 3A. The bore 2a is connected to the suction generating device SG so that the median portion of the sheet 22 is automatically attracted to the external surface of the section 3a and overlies the latter without the formation of any pleats or other irregularities. The portion 24a of the other gripping member 24 is pivoted against the trailing portion of the thus introduced sheet 22 to move the edge of the trailing portion inwardly, i.e., to the level of the external surface of the section 3b.

Successive increments of the median portion of the sheet 22 on the section 3a are contacted by liquid of the bath 26 in the vessel 27. The upper level 27a of the liquid bath 26 in the vessel 27 is sufficiently high to contact the median portion of the sheet 22 on the section 3a but is below the leading and trailing portions of such sheet. The vessel 27 receives developing liquid from a second vessel 28 which contains a main supply of developing liquid and is connected to the vessel 27 by a pipe 29. The vessel 28 is located at a level above the vessel 27 and the supply of liquid in the vessel 28 can be replenished continuously or at intervals (by lifting a pivotable lid 28a). The vessel 27 is provided with a suitable overflow opening 27b or with other means which insures that the level 27a remains constant or that it merely fluctuates within a narrow range so as to insure that a sheet 22 whose median portion overlies the section 3a contacts the developing liquid but the liquid cannot contact the leading and trailing portions of such sheet or any portion of the sheet 22A. The vessel 27 preferably contains one or more liquid agitating devices, e.g., rotary paddle wheels 30 and 31, which insure that each zone or stratum of the liquid bath 26 in the vessel 27 subjects the entire image-carrying surface of the median portion of a sheet 22 to developing action of equal intensity.

The visible image which is obtained on contact of the sheet 22 with liquid in the vessel 27 is thereupon fixed during passage of the sheet 22 along a source 35 of heat energy. This source is partially surrounded by a reflector 34. The parts 34 and 35 are installed at the intake end of a duct 36*a* which draws heated air from the housing 1. The discharge end of the duct 36*a* contains a fan 36 which causes a stream of air to flow along the external surface of the sheet 22 while the latter travels from the vessel 27 toward the heating device 35.

A sheet 22 which has been contacted by liquid in the vessel 27 and has been subjected to the action of heating device 35 is removed by hand and returned onto the platform 25 or placed onto another suitable support, not shown. The bore 2*a* is sealed from the suction generating device SG and the gripping members 24 are caused to disengage their portions 24*a* from the sheet 22 before the latter is withdrawn from the housing 1.

The gripping members 24 constitute a desirable feature of the improved apparatus because they invariably insure that the leading and trailing portions of a sheet 22 are not wetted during travel past the vessel 27. However, it is equally possible to provide other means for attracting the leading and trailing portions of a sheet 22 to the intermediate portions 103*a* and 103*b* or directly to the end portions of the section 3*b*. For example, the intermediate portions 103*a*, 103*b* can be provided with additional suction ports which perform the function of sheet engaging portions 24*a*. Furthermore, such suction ports can be provided in addition to the gripping members 24.

A sheet 22A is treated as follows: The leader of such sheet is caused to move toward the front portion of the section 3*b*, while the conveyor 3 rotates counterclockwise, as viewed in the drawing, so that it is attracted by the groove 6 and overlies, in its entirety, the external surface of the section 3*b*. The trailing portion of the sheet 22A is attracted by the groove 7. There is no need to provide jaws or analogous gripping members for the leading and trailing portions of a sheet 22A because the latter overlies the external surface of the section 3*a* which is always located above the upper level 27*a* of the liquid bath 26 in the vessel 27. A corona discharge wire 33 in a casing 32 is adjacent to the path of successive increments of the sheet 22A during movement from the platform 25 toward the vessel 27. The circuit of the wire 33 is completed when the apparatus is to treat sheets 22A whereby the wire destroys the charge on the sheet 22A and thereby insures that dust or other foreign matter does not adhere to such sheet before the latter is introduced into an ionography imaging chamber for exposure to object-modulated X-rays. Thus, a sheet 22A is cleaned whereas a sheet 22 is developed during transport through the housing 1. The cleaning device 32, 33 is preferably installed ahead of the vessel 27, as considered in the direction of rotation of the conveyor 3.

The sequence in which the apparatus treats sheets 22 and 22A can be selected at will. For example, an attendant will clean a supply of sheets 22A and will thereupon use the apparatus to develop the latent images of a series of sheets 22 which have been exposed to object-modulated X-rays. Alternatively, the attendant may decide to clean a sheet 22A, to introduce the cleaned sheet into an ionography imaging chamber for exposure to X-rays, and to thereupon introduce the sheet into the housing 1 for development of the latent image. In either event, the apparatus replaces two discrete units, namely, a conditioning or cleaning unit and a developing unit. This is achieved by providing the apparatus with a conveyor having an external surface of a length, as considered in the circumferential direction of the conveyor, which at least equals but preferably exceeds the combined length of two receptor sheets. Consequently, a sheet (22A) which overlies the section 3*b* need not contact the liquid in the vessel 27, and a sheet 22 which overlies the section 3*a* can be brought into contact with the liquid except for its leading and trailing portions to thus prevent the liquid from flowing behind such sheet, i.e., between the sheet and the external surface of the section 3*a*.

Another important advantage of the improved apparatus is that the contents of the vessel 27 need not be evacuated when an attendant desires to subject one or more sheets 22A to the action of the corona discharge device 32, 33.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. Apparatus for treatment of dielectric receptor sheets of predetermined length which are adapted to receive latent images, especially latent images of X-rayed objects, comprising a drum-shaped conveyor rotatable about a substantially horizontal axis and including first and second sections respectively having first and second convex external surfaces of larger and smaller radii, the length of said first surface in the circumferential direction of said conveyor being less than and the length of said second surface being at least equal to said predetermined length; discrete first and second sheet attracting means respectively associated with said first and second sections and being operable to attract sheets to the external surfaces of the respective sections whereby the leading and trailing portions of a sheet which carries a latent image and whose median portion overlies said first external surface extend inwardly of said first section; a liquid-containing vessel disposed below said conveyor; means for maintaining the upper level of liquid in said vessel in a plane which is located below said second external surface but is sufficiently high to enable the liquid to contact the median portion of a sheet which is attracted to said first surface; and a cleaning device adjacent to said conveyor and being operable to effect separation of dust or the like from a sheet which is attracted to said second surface.

2. Apparatus as defined in claim 1, wherein said predetermined length is less than one-half of the combined length of said first and second surfaces, as considered in the circumferential direction of said conveyor.

3. Apparatus as defined in claim 1, wherein said cleaning device includes a corona discharge device.

4. Apparatus as defined in claim 1, further comprising means for heating the wetted median portion of a sheet which is attracted to said first external surface, said heating means being located past said vessel, as considered in the direction of rotation of said conveyor.

5. Apparatus as defined in claim 1, wherein said conveyor further includes two intermediate portions disposed between said sections and having external surfaces sloping inwardly from said first to said second surface, said intermediate portions being overlapped by the leading and trailing portions of a sheet whose median portion overlies said first surface.

6. Apparatus as defined in claim 5, wherein said first attracting means includes mechanical gripping means operative to urge said leading and trailing portions against the respective intermediate portions of said conveyor.

7. Apparatus as defined in claim 1, further comprising a housing for said conveyor, said vessel and said cleaning device, said housing having an opening for introduction of sheets into the range of selected attracting means.

8. Apparatus as defined in claim 1, wherein said attracting means include suction generating means, suction ports provided in said surfaces, and means for connecting said ports with said suction generating means, said connecting means including channels provided in said conveyor.

9. Apparatus as defined in claim 1, further comprising means for circulating a hot fluid along the wetted median portion of a sheet which is attracted to said first surface.

10. Apparatus as defined in claim 1, wherein said cleaning device is located ahead of said vessel, as considered in the direction of rotation of said conveyor.

* * * * *